United States Patent [19]

Bohler et al.

[11] Patent Number: 4,885,975

[45] Date of Patent: Dec. 12, 1989

[54] DEFLECTOR SPROCKET FOR A CARTRIDGE FEED DEVICE IN AN AUTOMATIC MULTI-BARREL FIRING WEAPON

[75] Inventors: Erwin Bohler, Dubendorf; Werner Bruderer, Zurich, both of Switzerland

[73] Assignee: Werkzeugmaschinenfabrik Oerlikon-Bührle AG, Zurich, Switzerland

[21] Appl. No.: 225,489

[22] Filed: Jul. 28, 1988

Related U.S. Application Data

[63] Continuation of Ser. No. 937,691, Dec. 5, 1986, abandoned.

[30] Foreign Application Priority Data

Dec. 10, 1985 [CH] Switzerland ..... 05257/85

[51] Int. Cl.[4] ..... F41D 10/04; F41D 10/28

[52] U.S. Cl. ..... 89/33.25; 89/12

[58] Field of Search ..... 89/33.16, 33.17, 33.25, 89/12, 13.05, 13.1

[56] References Cited

U.S. PATENT DOCUMENTS

| | | | |
|---|---|---|---|
| 2,993,415 | 7/1961 | Panicci et al. | 89/33.2 |
| 3,319,524 | 5/1967 | Jassie | 89/33.01 |
| 3,421,409 | 1/1969 | Findlay | 89/33.25 |
| 3,429,221 | 2/1969 | Kirkpatrick | 89/33.16 |
| 3,437,005 | 4/1969 | Trumper | 89/33.17 |
| 3,492,913 | 2/1970 | Barnard | 89/33.16 |
| 4,658,701 | 4/1987 | Moore | 89/33.25 |

FOREIGN PATENT DOCUMENTS

| | | | |
|---|---|---|---|
| 35571 | 9/1981 | European Pat. Off. . | |
| 744343 | 1/1944 | Fed. Rep. of Germany | 89/33.25 |
| 151647 | 10/1921 | United Kingdom | 89/33.25 |

*Primary Examiner*—Charles T. Jordan
*Assistant Examiner*—Stephen Johnson
*Attorney, Agent, or Firm*—Werner W. Kleeman

[57] ABSTRACT

Cartridges are usually fed axially to a rotating array of barrels of a multi-barrel cannon or firing weapon, by means of a cartridge feeding apparatus, for example, an endless conveyor belt or chain. The cartridges must then be accelerated to the peripheral speed of the rotating array of barrels, since the spacing between the individual barrels is considerably greater than the pitch spacing between successive cartridges on the endless conveyor belt or chain. Uniform acceleration of cartridges fed by the conveyor belt or chain up to the peripheral speed of the rotating array of barrels of the firing weapon is effected in that the deflector wheel or sprocket comprises a predetermined number of radially adjustable slides. These radially adjustable slides define recesses or pockets for receiving the cartridges. Structure, such as a cam arrangement, is also provided for radially translating these slides during rotation of the deflector wheel or sprocket.

3 Claims, 3 Drawing Sheets

DEFLECTOR SPROCKET FOR A CARTRIDGE FEED DEVICE IN AN AUTOMATIC MULTI-BARREL FIRING WEAPON

CROSS-REFERENCE TO RELATED CASE

This application is a continuation of the commonly assigned, co-pending U.S. application Ser. No. 06/937,691, filed Dec. 5, 1986, entitled "DEFLECTOR SPROCKET FOR A CARTRIDGE FEED DEVICE IN AN AUTOMATIC MULTI-BARREL FIRING WEAPON", now abandoned.

BACKGROUND OF THE INVENTION

The present invention broadly relates to a new and improved construction of an apparatus for feeding cartridges to an automatic firing weapon.

In its more specific aspects, the present invention relates to a new and improved construction of a deflector wheel or sprocket for feeding cartridges to an automatic multi-barrel cannon or firing weapon comprising a rotating array of barrels. The deflector wheel or sprocket transfers the conveyed or delivered cartridges from the endless conveyor belt or chain to the multi-barrel cannon or firing weapon. The deflector wheel or sprocket comprises a predetermined number of uniformly spaced recesses or pockets at its circumference for accommodating the cartridges.

In a heretofore known cartridge feeding apparatus of this type (see U.S. Pat. No. 2,993,415, granted July 25, 1961) the cartridges are likewise fed to a multi-barrel cannon or gun having a rotating array of barrels by means of an endless conveyor belt. However, in lieu of a deflector wheel or sprocket deflecting the conveyor belt or chain for feeding the cartridges to the multi-barrel cannon or gun, and extractor wheel or sprocket shifts the cartridges off the conveyor belt or chain for conveying them to the weapon. In this extraction process, the cartridges must be accelerated, since the pitch of the conveyor belt or chain is considerably less than the corresponding spacing between individual firing barrels of the rotating array of barrels. In accordance with the short pitch of the conveyor belt or chain, the cartridges move considerably slower than the peripheral speed of the rotating weapon barrels (the speed relationship between the delivered cartridges and the rotating array of firing barrels is, for instance, exemplified in FIG. 2 of the present application). The extractor wheel or sprocket accelerates the cartridges up to the peripheral speed of the rotating array of barrels.

In another heretofore known embodiment of a cartridge feeding arrangement of this type disclosed in U.S. Pat. No. 3,437,005, granted Apr. 8, 1969, cartridges are fed to a multi-barrel cannon or gun by means of a screw conveyor rather than by an endless conveyor belt or chain. Instead of a deflector wheel or sprocket deflecting the conveyor belt or chain, an extractor wheel or sprocket conveys the cartridges from the screw conveyor to the individual barrels of the gun or firing weapon. The disadvantage of this arrangement lies in the requisite abrupt acceleration of the cartridges since the peripheral speed o the extractor wheel or sprocket is equivalent to the peripheral speed of the array of barrels, while the cartridges within the screw conveyor move at a much slower rate corresponding to the smaller spacing prevailing between individual cartridges.

SUMMARY OF THE INVENTION

Therefore, with the foregoing in mind, it is a primary object of the present invention to provide a new and improved construction of an apparatus for feeding cartridges to an automatic firing weapon.

A further significant object of the present invention is to provide a new and improved construction of an apparatus for feeding cartridges to a firing weapon comprising a deflector wheel or sprocket which uniformly accelerates cartridges conveyed by a conveyor belt or chain up to the peripheral speed of the rotating array of firing barrels of the firing weapon.

When deflecting the conveyor belt or chain by the deflector wheel or sprocket, the cartridges on the conveyor belt or chain describe a considerably larger circular arc than the conveyor belt or chain. This in itself accelerates the cartridges. This acceleration alone, however, does not provide the necessary speed for introducing the cartridges into the firing weapon. The inventive deflector wheel or sprocket as constructed serves to further accelerate the individual cartridges.

Now in order to implement these and still further objects of the present invention, which will become more readily apparent as the description proceeds, the cartridge feeding apparatus of the present invention is manifested, among other things, by the features that the deflector wheel or sprocket comprises a predetermined number of radially adjustable slides which define the recesses or pockets for accommodating the cartridges, and that means are provided for moving or translating these radially adjustable slides in a radial direction during rotation of the deflector wheel or sprocket.

Preferably the means for radially moving or translating the radially adjustable slides comprises a cam arrangement including a stationary control curve or cam profile. A roller or follower roll is affixed to each slide in contact with the control curve or cam profile for following this control curve or cam profile upon rotation of the deflector wheel or sprocket. Preferably this control curve or cam profile comprises a guide groove for guiding the rollers or follower rolls affixed to the radially adjustable slides and protruding into this guide groove.

It is also conceivable to construct the deflector wheel or sprocket according to the invention in a different construction than that described herein, such that the endless conveyor belt or conveyor chain is deflected by means of a deflector or deflection roller of relatively small radius. The cartridges on the conveyor belt or chain would then move in a circular arc of relatively larger radius as compared to the relatively small radius of the deflector or deflection roller, which would also permit the cartridges to be accelerated up to the desired speed. This however would lead to a less favorable design of the conveyor belt or chain.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have generally used the same reference characters to denote the same or analogous components and wherein.

DETAILED DESCRIPTION OF THE PREFERRED EMBODIMENTS

Figure 1:
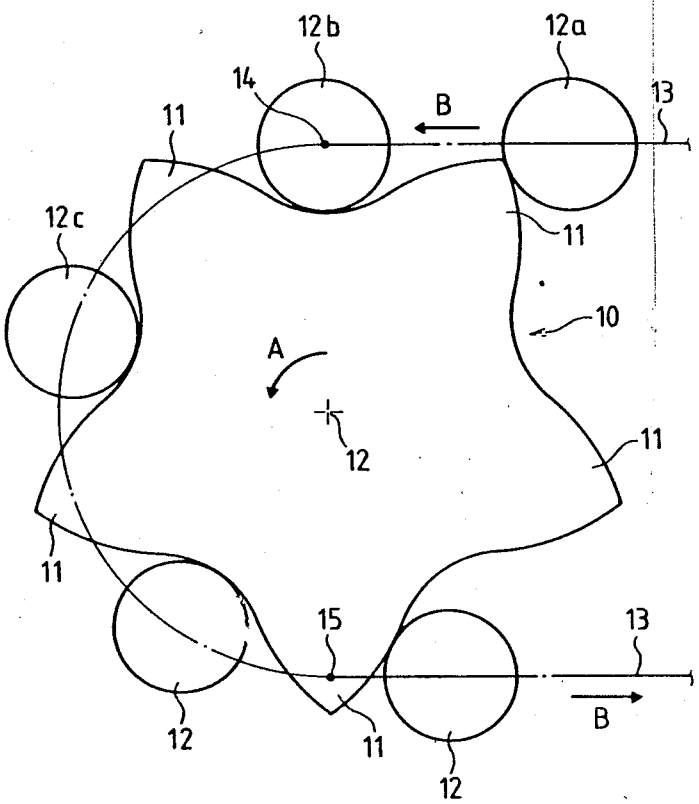
PRIOR ART FIG. 1
FIG. 1 shows a generally known deflector wheel or sprocket, hitherto used in cartridge feeding apparatuses.

Describing now the drawings, it is to be understood that to simplify the showing thereof only enough of the structure of the cartridge feeding apparatus has been illustrated therein as is needed to enable one skilled in the art to readily understand the underlying principles and concepts of the present invention. Turning now specifically to FIG. 1 of the drawings, a heretofore known type of star wheel or sprocket 10 comprising five teeth 11 rotates in the direction of arrow A about an axis 12. An endless conveyor belt or chain 13 is driven in the direction of the arrows B by means of this star wheel 10. This conveyor belt or chain 13 is conveniently depicted in FIG. 1 by a dash-dotted line. Within this conveyor belt or chain 13 there are located cartridges 12, of which FIG. 1 depicts only the cartridge base. The shape of the teeth 11 is determined by the process of moving the cartridges 12 along a linear path of motion from which they must be deflected into a circular or arcuate path of motion, and then deflected back to a linear path of motion. The transition from a linear path of motion to a circular path of motion and the transition back from a circular path of motion to a linear path of motion is indicated at points 14 and 15. Bending or flexing of the conveyor belt or chain 13 by the known type of star wheel or sprocket 10 causes an increase in distance or pitch spacing between individual cartridges 12. Thus, the distance or pitch spacing between the cartridges **12*a* and 12*b* is considerably less than the distance or pitch spacing between the cartridges 12*b* and 12*c*. This change in distance or pitch spacing causes acceleration forces to act upon the cartridges 12**.

Figure 2:
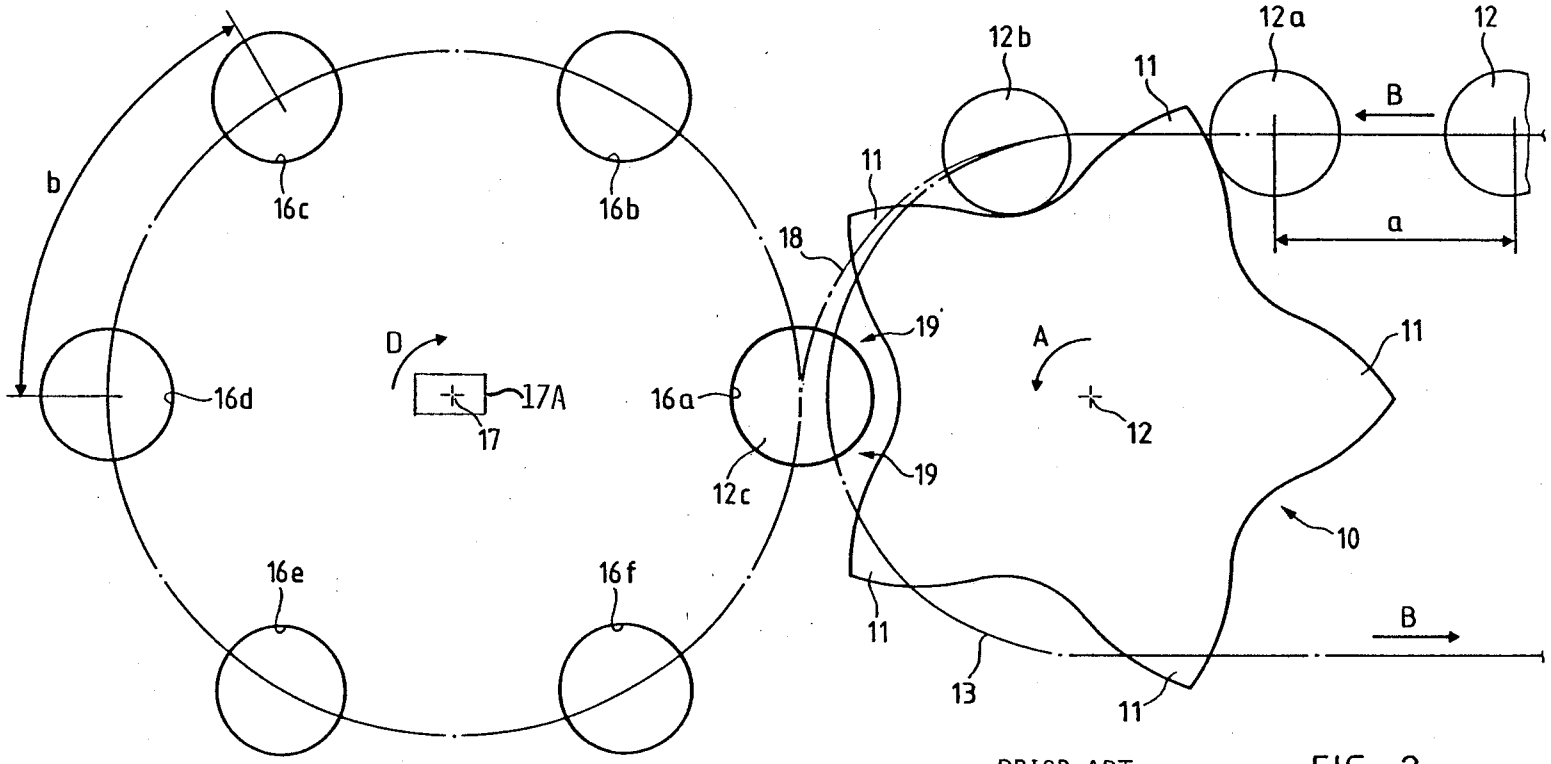
FIG. 2 PRIOR ART
FIG. 2 shows the deflector wheel or sprocket of FIG. 1 adjacent to a multi-barrel cannon.

According to FIG. 2, the cartridges 12 are fed to a multi-barrel firing weapon or gun of which there are indicated only six firing barrels 16. The six firing barrels 16 are mounted within a housing (not specifically depicted here), which rotates about an axis 17 in the direction of the arrow D under the action of rotational drive means 17A. The firing barrel **16*a* has an axis which coincides with an axis of the cartridge 12*c*. During rotation of the star wheel or sprocket 10 and the six firing barrels 16 in the direction of arrows A and D, the subsequent cartridge 12*b* approaches the subsequent firing barrel 16*b*, and as a consequence the cartridge 12*b* moves along the dash-dotted line 18. There is play 19 between the teeth 11 of the known type of star wheel 10 and the cartridge 12*c*, causing unreliable guidance of cartridge 12*c* and possibly interfering with cartridge delivery. With the deflector wheel or sprocket 20** according to the invention, such interference can be eliminated.

Figure 3:
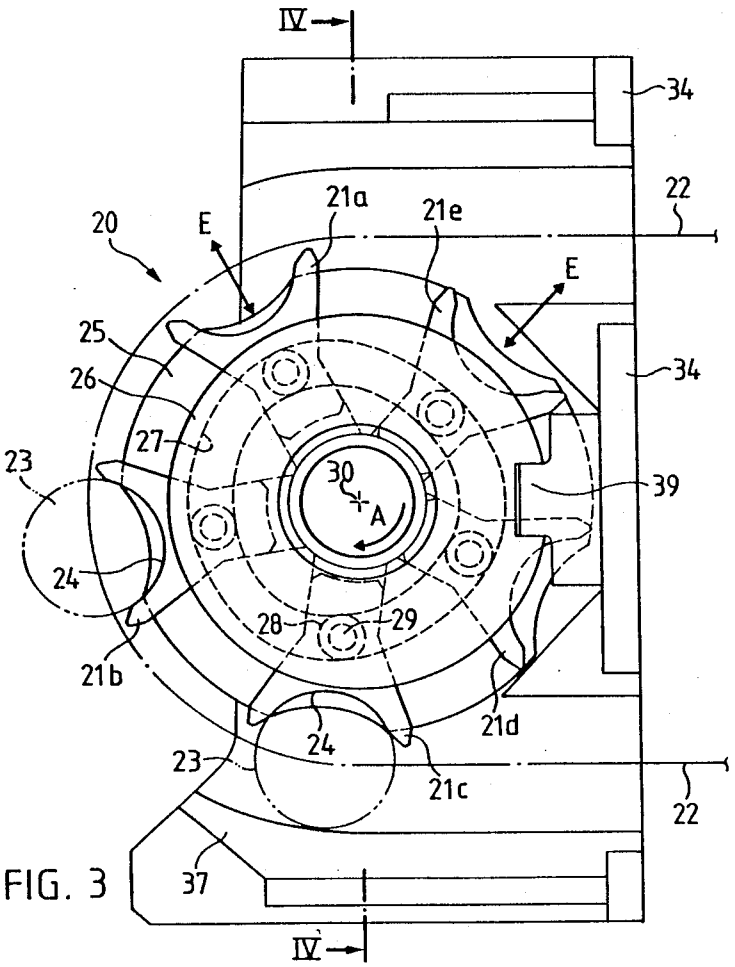
FIG. 3 shows a deflector wheel or sprocket according to the invention.

According to FIG. 3, the deflector wheel or sprocket 20 according to the invention comprises five radially adjustable slides or slide members 21 which are radially movable on the deflector wheel or sprocket 20, as indicated by the doubled-headed arrows E. This deflector wheel or sprocket 20 propels an endless conveyor belt or chain 22 in the direction of arrow B whenever the deflector wheel or sprocket 20 is rotating in the direction of the arrow A. Cartridges 23 conveyed by the conveyor belt or chain 22 are fed into recesses or pockets 24 of the radially adjustable slides 21. The conveyor belt or chain 22 is conveniently indicated by a dash-dotted line. The radially adjustable slides 21 are radially movably supported within a disc or plate 25 which can rotate in the direction of the arrow A. In front of this disc 25 there is located a cam disc or cam 26 which cannot be rotated. This cam disc 26 comprises a guide groove or control curve or cam profile 27 into which there protrude rollers or follower rolls 28, each supported by a respective pin or axle 29 fastened to the slides 21.

According to FIG. 3, the guide groove 27 is located at a lesser distance from the axis 30 of the deflector wheel or sprocket 20 on the right-hand section of the cam disc 26 than on the left-hand section. Thus, the three radially adjustable slides **21*a*, 21*b* and 21*c* are positioned at a greater distance from the axis 30 than the radially adjustable slides 21*d* and 21*e*. Hence, upon rotation of the disc or plate 25, the radially adjustable slide 21*d* shifts radially outwardly and at the same time the radially adjustable slide 21*a* shifts radially inwardly, whenever the deflector wheel or sprocket 20 rotates by a fifth of a revolution or turn from the depicted position in the direction of the arrow A. The guide groove 27, herein indicated only schematically, may be designed such that the cartridge 12*b* according to FIG. 2 does not move along a circular path, but instead along a helical path like the path 18, however, such that no undesirable play like the play 19 indicated in FIG. 2 will occur and the cartridge is accelerated up to the aforementioned peripheral speed of the rotating firing barrel 16*b***.

Figure 4:
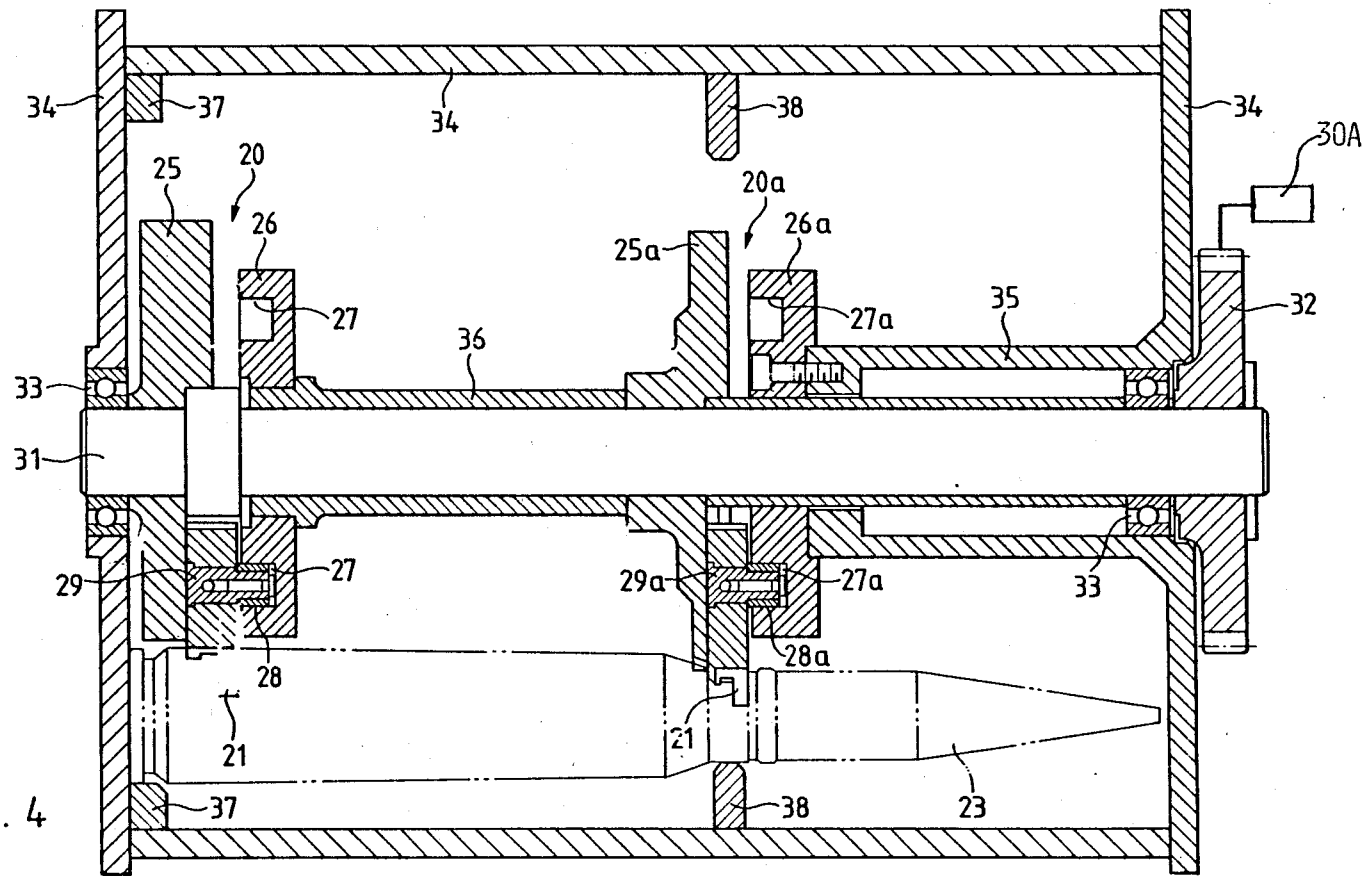
FIG. 4 shows a section defined by line IV—IV in FIG. 3.

According to the detailed showing of FIG. 4, there are arranged on a shaft 31, a first deflector wheel or sprocket 20 and a second deflector wheel or sprocket **20*a*. The first deflector wheel or sprocket 20 is arranged at the rear or base end of the cartridges 23 to be conveyed, and the second deflector wheel or sprocket 20*a*, engages the cartridges 23 in the region of the cartridge case mouth. Respective discs or plates 25 and 25*a* of the first deflector wheel or sprocket 20 and the second deflector wheel or sprocket 20*a*, are fastened to the shaft 31 and rotate conjointly with this shaft 31. A gear 32 is also arranged on the right-hand side of the shaft 31, and which gear 32 may be driven by any suitable and thus merely schematically indicated motor or rotating means 30A. The shaft 31 is supported within a housing 34 by two ball bearings 33. The cam disc 26*a*, which must not rotate, is fastened to the housing 34 by means of a sleeve 35 and is thus prevented from rotating. Of the five radially adjustable slides 21 shown in FIG. 3, FIG. 4 shows only one radially adjustable slide 21 and one radially adjustable slide 21'. Within each radially adjustable slide 21 and 21' there is fastened a respective pin 29 and pin 29*a* each of which carries one respective roller or follower roll 28 and roller or follower roll 28*a* which protrude into the respective guide groove 27 and the guide groove 27*a*. Within the housing 34 there are fastened guide rails 37 and 38 which prevent the cartridge 23 from dropping out of the radially adjustable slides 21 and 21', respectively. According to FIG. 3, the other cam disc 26 is prevented from rotating or turning by means of a tab or lug 39 which is fastened to the housing 34. Between the cam disc 26 and the cam disc 25, there is arranged a sleeve 36**.

The operation of the herein described cartridge conveying or feed arrangement is as follows:

The multi-barrel cannon or firing weapon or gun with a rotating array of barrels, comprising six firing barrels 16*a*, 16*b*, 16*c*, 16*d*, 16*e* and 16*f*, is capable of firing from each barrel, for instance, 700 cartridges 12 or 23, as the case may be, per minute. This means that 4,200 cartridges would have to be conveyed per minute by the known type of star wheel or sprocket 10 (FIG. 2), or by the inventive deflector wheel or sprocket 20 (FIG. 3), and that the deflector wheel or sprocket 20 turns 840 times per minute, since it conveys five cartridges with each revolution. As indicated by these few values and the prior comments it is evident that the acceleration of the cartridges 12 or 23 to the peripheral speed of the rotating array of firing barrels 16*a* to 16*b* is of great importance. As long as the conveyor belt or chain 13 (FIG. 2) or the conveyor belt or chain 22 (FIG. 3), is under tension, the distance or pitch spacing a between each two successive cartridges, such as the cartridges 12*b* and 12*a* (FIG. 2), is considerably less than the length of the circular arc b between the successive firing barrels, such as the firing barrels 16*c* and 16*d* (FIG. 2). In accordance with the difference in length between the pitch spacing a and the circular arc b, the cartridge must be accelerated to a greater speed. For this acceleration, the cartridges 12 or 23 are moved according to FIG. 2 along a helical path 18, providing an acceleration up to approximately the desired speed. The manner by which respective cartridges 12 or 23 are brought into motion along the helical path 18 (FIG. 2) is shown in FIG. 3. During the transition of a radially adjustable slide or slide member 21 from a first position as indicated by the depicted slide 21*d* to a second position as indicated by the slide 21*c*, a cartridge 23 is repositioned from the endless conveyor belt or chain 22 into the associated recess or pocket 24 of the radially adjustable slide 21*c*, and at the same time the radially adjustable slide 21*d*, as it moves to the position indicated by the depicted slide 21*c*, is radially displaced, since the roller or follower roll 29 of the radially adjustable slide 21*d* is located within the rising section of the guide groove or cam profile 27 of the stationary cam disc 26. The cartridge 23 is moved tangentially against the deflector wheel or sprocket 20 in order to arrive in one of the recesses or pockets 24 of the radially adjustable slides 21*a*, 21*b*, 21*c*, 21*d*, 21*e* and the cartridge 23 is moved radially outwardly by the corresponding radially adjustable slide 21*d* while being uniformly accelerated up to the peripheral speed of the associated one of the firing barrels 16*a* through 16*f*. Corresponding functions of the further radially adjustable slide 21' associated with the other stationary cam disc 26*a* are effected by their interaction with the associated guide groove 27*a*.

While there are shown and described present preferred embodiments of the invention, it is to be distinctly understood that the invention is not limited thereto, but may be otherwise variously embodied and practiced within the scope of the following claims. Accordingly,

What we claim is:

1. A rotatable deflector wheel arrangement for a cartridge feed device in an automatic multi-barrel cannon having a rotatable array of barrels and an endless conveyor chain for conveying the cartridges, comprising:

means defining a predetermined number of recesses for accommodating the cartridges;

said predetermined number of recesses being uniformly peripherally spaced around the rotatable deflector wheel arrangement;

said rotatable deflector wheel arrangement being operable for transferring said cartridges to the rotatable array of barrels;

said recess defining means comprising a predetermined number of radially adjustable slides defining said predetermined number of uniformly peripherally spaced recesses for accommodating the cartridges and being radially adjustable relative to said rotatable deflector wheel arrangement;

means for successively radially outwardly moving said radially adjustable slides in radial direction of said rotatable deflector wheel arrangement during rotation of the rotatable deflector wheel arrangement in order to thereby feed said cartridges to the rotatable array of barrels at a speed substantially equal to a predetermined peripheral speed of said rotatable array of barrels;

said means for successively radially outwardly moving said radially adjustable slides being operatively associated with said rotatable deflector wheel arrangement and comprises at least one stationary cam disc having a predetermined curvature and serving for radially displacing said radially adjustable slides;

a respective roller operatively associated with each said radially adjustable slide;

said rollers contacting said at least one stationary cam disc such that each said roller follows said predetermined curvature of said at least one stationary cam disc in order to thereby impart to said cartridges accommodating by said radially adjustable slides, said speed substantially equal to said predetermined peripheral speed of said rotatable array of barrels;

barrel array drive means for rotating the rotatable array of barrels at a predetermined rotational speed and thus at said predetermined peripheral speed of said rotatable array of barrels;

at least one deflector wheel of said recess defining means;

said at least one deflector wheel radially movably supporting said predetermined number of radially adjustable slides;

deflector wheel drive means rotationally driving said at least one deflector wheel and thereby said cartridges accommodated in said uniformly peripherally spaced recesses, at a predetermined rotational speed and thereby at a peripheral speed which is lower than said predetermined peripheral speed of said barrels;

said means for successively radially outwardly moving said radially adjustable slides successively accelerating said cartridges accommodated in said uniformly peripherally spaced recesses, from said predetermined peripheral speed to speed substantially equal to said predetermined peripheral speed of said barrels for delivery to said barrels;

a rotatably journalled shaft;

said at least one deflector wheel constituting a first deflector wheel and a second deflector wheel;

said first deflector wheel and said second deflector wheel being fastened to said rotatably journalled shaft;

at least one of said first deflector wheel and said second deflector wheel slidingly contains said predetermined number of radially adjustable slides;

said first deflector wheel being located at a rear end of said cartridge to be transported and said second deflector wheel being located within the region of a cartridge case mouth; and said first deflector wheel and said second deflector wheel together with said predetermined number of radially adjustable slides and said at least one stationary cam disc defining said rotatable deflector wheel arrangement.

2. The rotatable deflector wheel arrangement as defined in claim 1, wherein:

said at least one stationary cam disc comprises a guide groove possessing said predetermined curvature; and said rollers being connected to said radially adjustable slides and protruding into said guide groove.

3. The rotatable deflector wheel arrangement as defined in claim 1, wherein:

each one of said first deflector wheel and said second deflector wheel slidingly contains an associated predetermined number of radially adjustable slides;

said at least one stationary cam disc comprises two stationary cam discs; and each deflector wheel of said first deflector wheel and said second deflector wheel being provided with an associated one of said two stationary cam discs for displacing said radially adjustable slides which are associated with said first deflector wheel and said second deflector wheel.

* * * * *